US010705469B2

(12) United States Patent
Ishikura

(10) Patent No.: US 10,705,469 B2
(45) Date of Patent: Jul. 7, 2020

(54) MEDIUM CUTTING DEVICE AND IMAGE FORMING APPARATUS

(71) Applicant: Oki Data Corporation, Tokyo (JP)

(72) Inventor: Hiroki Ishikura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 5 days.

(21) Appl. No.: 16/105,243

(22) Filed: Aug. 20, 2018

(65) Prior Publication Data

US 2019/0064724 A1 Feb. 28, 2019

(30) Foreign Application Priority Data

Aug. 31, 2017 (JP) ..... 2017-166576

(51) Int. Cl.

| | |
|---|---|
| ***B65H 23/00*** | (2006.01) |
| ***G03G 15/00*** | (2006.01) |
| ***B65H 35/06*** | (2006.01) |
| ***B65H 35/00*** | (2006.01) |

(52) U.S. Cl.

CPC ..... *G03G 15/6523* (2013.01); *B65H 23/00* (2013.01); *B65H 35/0086* (2013.01); *B65H 35/06* (2013.01); *B65H 2301/51532* (2013.01); *B65H 2801/27* (2013.01)

(58) Field of Classification Search

CPC .... B65H 23/00; B65H 35/0086; B65H 35/06; B65H 2301/51532; B65H 2801/27; D06H 7/20

See application file for complete search history.

(56) References Cited

U.S. PATENT DOCUMENTS 2,659,437 A * 11/1953 Huck ..... B41F 13/60 83/154
2,868,292 A * 1/1959 Hitchcock ..... B23D 25/12 83/341
2011/0026999 A1* 2/2011 Kohira ..... B26D 1/085 400/621

FOREIGN PATENT DOCUMENTS

JP 2004-330356 A 11/2004

* cited by examiner

*Primary Examiner* — Andrea L Wellington
*Assistant Examiner* — Liang Dong
(74) *Attorney, Agent, or Firm* — Muncy, Geissler, Olds & Lowe, P.C.

(57) ABSTRACT

A medium cutting device cutting a continuous medium carried along a carrying path in a carrying direction includes a sandwiching part that is provided capable of sandwiching a medium; and a cutting blade that includes an edge extending in a width direction (X) of the medium, which is perpendicular to the carrying direction, wherein the medium is cut by the edge while the medium is sandwiched and held by the sandwiching part. Wherein the edge is in a shape depicting an involute curve in which path lengths (PL) of the medium, which are determined from the sandwiching part to the edge in the carrying direction, are substantially constant over the edge in the width direction.

16 Claims, 12 Drawing Sheets

MEDIUM CUTTING DEVICE AND IMAGE FORMING APPARATUS

TECHNICAL FIELD

The present invention relates to a medium cutting device and an image forming apparatus provided with the medium cutting device.

BACKGROUND

An image forming apparatus has been known in which a roll sheet as a medium set in a medium supply part is sequentially fed out, and the roll sheet is cut at a predetermined length, and printing is performed on the cut sheet (for example, see Patent Document 1).

RELATED ART

[Patent Doc. 1] JP Laid-Open Patent Application Publication 2004-330356

In such an image forming apparatus, it is desired that the cutting operation of the medium is performed with higher accuracy.

Therefore, it is desirable to provide a medium cutting device capable of performing a cutting operation of a medium with higher accuracy, and to provide an image forming apparatus provided with the medium cutting device.

SUMMARY

A medium cutting device, disclosed in the application, cutting a continuous medium carried along a carrying path in a carrying direction includes a sandwiching part that is provided capable of sandwiching a medium; and a cutting blade that includes an edge extending in a width direction (X) of the medium, which is perpendicular to the carrying direction, wherein the medium is cut by the edge while the medium is sandwiched and held by the sandwiching part. Wherein the edge is in a shape depicting an involute curve in which path lengths (PL) of the medium, which are determined from the sandwiching part to the edge in the carrying direction, are substantially constant over the edge in the width direction.

An image forming apparatus, disclosed in the application, includes the medium cutting device discussed above and an image forming part that is configured to process an image forming.

According to the medium cutting device and the image forming apparatus as an embodiment of the present disclosure, the edge for cutting the medium is in a shape depicting the involute curve in which path lengths (PL) of the medium are substantially constant over the edge in the width direction. Thereby, a secure cutting operation is performed from one edge to the other edge of the medium.

According to the medium cutting device and the image forming apparatus as an embodiment of the present disclosure, a cutting operation of the medium can be performed with higher accuracy. The effects of the present invention are not limited to this, and may include any of the effects described below.

DETAILED DESCRIPTIONS OF PREFERRED EMBODIMENTS

Figure 1A:
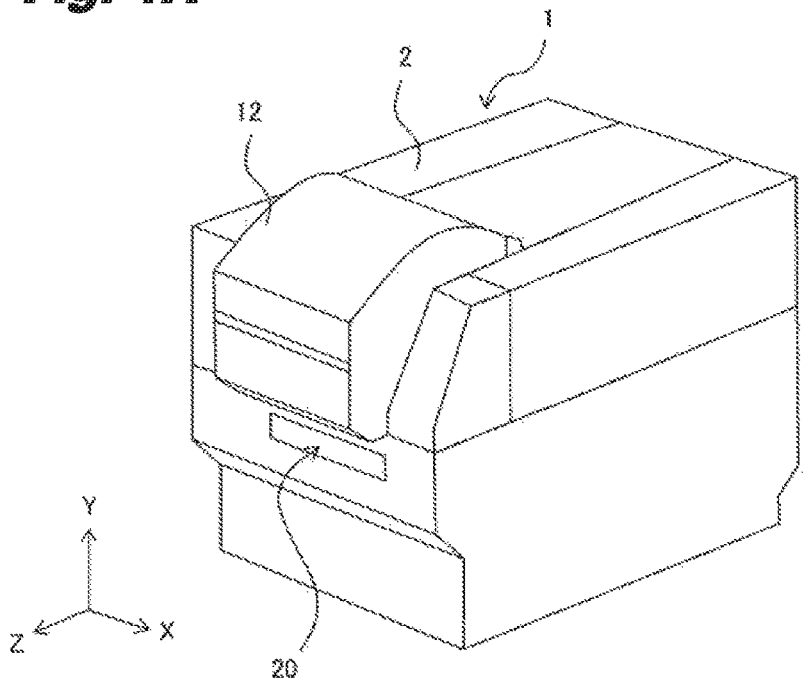
FIG. 1A is a perspective view illustrating an example of an overall configuration of an image forming apparatus according to an embodiment of the present invention.

In the following, an embodiment of the present invention is described with reference to the drawings. The following description is a specific example of the present invention. The present invention is not limited to the following embodiments. Further, the present invention is not limited to arrangements, dimensions, dimension ratios and the like of configuration elements illustrated in the drawings. The description will be presented in the following order:

1. Embodiment

An image forming apparatus provided with a medium cutting device.

2. Modified Embodiments

1. Embodiment

[1-1. Schematic Configuration of Image Forming Apparatus 1]

Figure 1B:
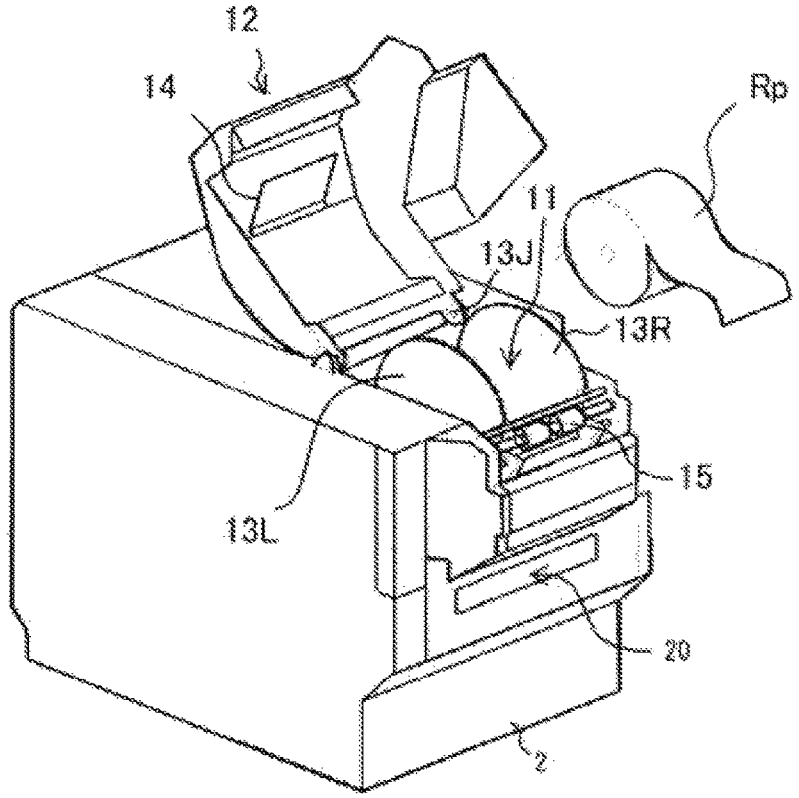
FIG. 1B is another perspective view illustrating the example of the overall configuration of the image forming apparatus illustrated in FIG. 1A.
Figure 2:
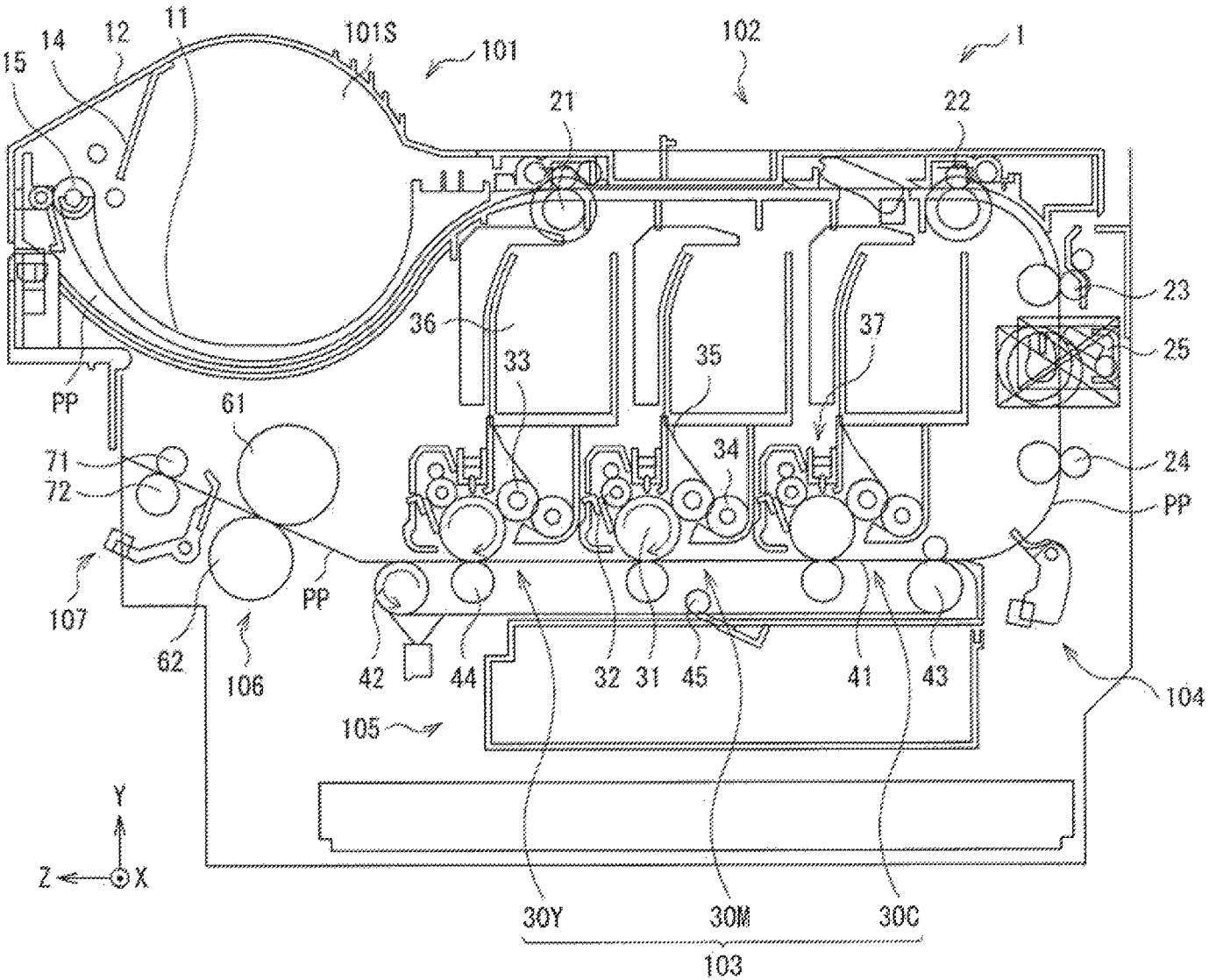
FIG. 2 is a schematic view illustrating an internal structure of the image forming apparatus illustrated in FIG. 1A.
Figure 3:
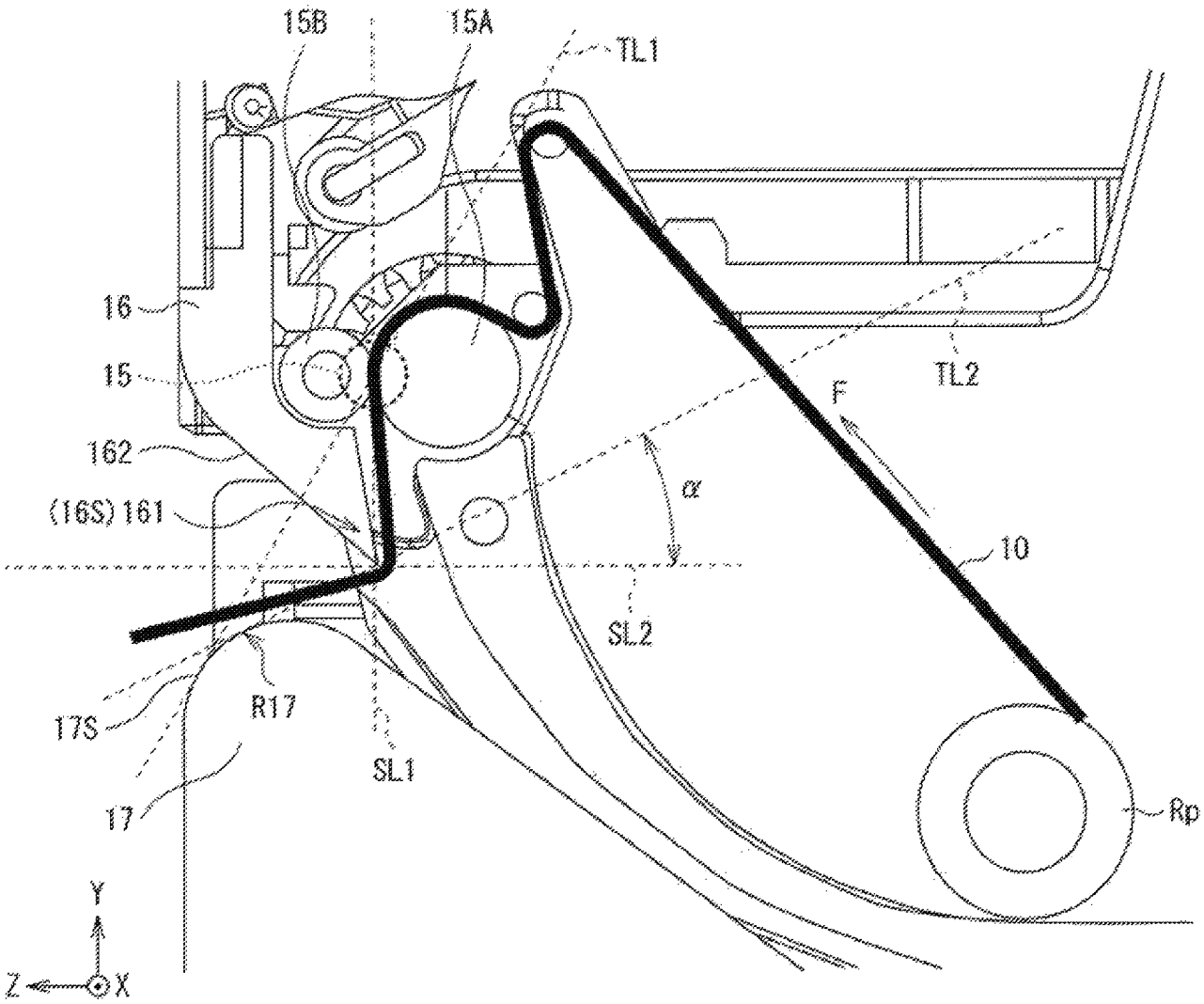
FIG. 3 is an enlarged schematic view illustrating a portion of the internal structure of the image forming apparatus illustrated in FIG. 2.

FIG. 1A is a perspective view illustrating an external appearance of an image forming apparatus 1 according to an embodiment of the present invention. FIG. 1B is a perspective view illustrating the image forming apparatus 1 illustrated in FIG. 1A in such a manner that a portion of an internal configuration thereof is visible. FIG. 2 is a schematic view illustrating an example of an overall internal configuration of the image forming apparatus 1 illustrated in FIG. 1A. FIG. 3 is an enlarged schematic view illustrating a portion of an internal structure of the image forming apparatus 1.

The image forming apparatus 1 includes, for example, inside a case 2, for example, a medium supply part 101, a medium carrying part 102, an image forming part 103, a transfer device 104, a developer collection device 105, a fuser device 106, and an ejection part 107. A carrying path PP is further formed in the image forming apparatus 1. The carrying path PP is a path through which a medium 10 passes and which starts from the medium supply part 101, sequentially passes through the medium carrying part 102, the image forming part 103 and the transfer device 104, the developer collection device 105, the fuser device 106, and the ejection part 107, and finally reaches the outside of the case 2. In the present specification, a direction approaching the medium supply part 101 from an arbitrary position on the carrying path PP, or a position that is closer to the medium supply part 101 than the arbitrary position is (a position between the arbitrary position and the medium supply part 101) is referred to as upstream. On the other hand, a direction away from the medium supply part 101 from an arbitrary position on the carrying path PP, or a position that is closer to the ejection part 107 than the arbitrary position (a position between the arbitrary position and the ejection part 107) is referred to as downstream. The medium supply part 101, the image forming part 103 and the carrying path PP are respectively specific examples of "a medium supply part," "an image forming part" and "a carrying path" of the present invention.

(Medium Supply Part 101)

The medium supply part 101 supplies a medium 10 toward the image forming part 103. The medium supply part 101 includes a holding part 11, a cover 12, a pair of side guides 13L, 13R, and a guide 14 erected on an inner surface of the cover 12. Between the medium supply part 101 and the medium carrying part 102, a sandwiching part 15 (a carrying roller 15A and a pinch roller 15B), a cutter 16 and a contact part 17 are provided as a specific example corresponding to "a medium cutting device" of the present invention. This medium cutting device removes a front end portion of the medium 10 drawn out from the medium supply part 101 and then guides the medium 10, of which the front end portion has been removed, to the carrying path PP.

The holding part 11 is a part that holds a roll Rp as a supply source of the medium 10 on which an image is formed, and, together with the cover 12, forms a space 101S accommodating the roll Rp. The cover 12 is a protective member that is provided so as to cover the roll Rp accommodated in the space 101S. The roll Rp is formed by winding a continuous sheet. As the medium 10, it is also possible to use a medium formed by intermittently providing multiple stickers on a continuous sheet. Further, a material of the continuous sheet is not limited to paper, but may be, for example, a transparent resin or the like. The pair of side guides 13L, 13R is a member for guiding lateral sides of the roll Rp accommodated in the space 101S. The guide 14 is a member that guides the medium 10 fed out from the roll Rp so that the medium 10 stably travels toward the carrying path PP. The carrying roller 15A and the pinch roller 15B are arranged opposing each other with the medium 10 sandwiched therebetween, and form the sandwiching part 15. The sandwiching part 15 is a specific example corresponding to "a sandwiching part" of the present invention, and the carrying roller 15A and pinch roller 15B are a specific example corresponding to "a pair of rotating bodies" of the present invention. The carrying roller 15A, in cooperation with the pinch roller 15B, functions to feed out the medium 10 from the roll Rp and sequentially carry the medium 10 toward the medium carrying part 102. The carrying roller 15A is rotatably supported directly or indirectly by the case 2, whereas the pinch roller 15B is rotatably supported by the cover 12. The medium supply part 101 further includes a sheet feeding motor 811 (described in FIG. 9 below). The carrying roller 15A is rotationally driven by the sheet feeding motor 811.

The cutter 16 is a medium cutting member that, for example, is detachably provided with respect to the cover 12, and includes an edge 161 that, for example, cuts the medium 10, which is carried (fed out) from upstream to downstream along the carrying path PP, along a width direction (X axis direction) orthogonal to a carrying direction. The cutter 16 is formed of, for example, a resin, and cuts, with the edge 161, along the X axis direction, the medium 10, which is drawn out from the roll Rp set in the space 101S, and forms a leading edge surface 10S extending along the X axis direction in the medium 10. The edge 161 has, for example, a curvature R161. Here, the cutter 16 is a specific example corresponding to "a cutting blade" of the present invention; the edge 161 is a specific example corresponding to "an edge" of the present invention; and the curvature R161 is "a first curvature" of the present invention. Details of the cutter 16 will be described later.

The contact part 17 is fixed, for example, to the case 2, and may function as a support part supporting the medium 10 when the medium 10 is cut at the edge 161. The contact part 17 is positioned on an opposite side with respect to the sandwiching part 15 as viewed from the edge 161, that is, on a downstream side of the edge 161 in a carrying direction F. Further, the carrying path PP is formed between the cutter 16 and the contact part 17. The contact part 17 is positioned on an opposite side with respect to the cutter 16 across the carrying path PP of the medium 10. The contact part 17 includes a convex contact surface 17S which can be in contact with the medium 10. The contact surface 17S has, for example, a curvature R17 smaller than the curvature R161. At least a portion of the edge 161, in this example, an end portion 161E1 and an end portion 161E2 (to be described later), is preferably positioned on the contact part 17 side of a tangent TL1 of the contact surface 17S passing through the sandwiching part 15. This is because the medium 10 can be smoothly cut. Further, the contact surface 17S is desirably formed of only a continuous surface that does not include a bent portion. This is to avoid that a localized stress is applied to the medium 10 in contact with the contact surface 17S. The contact surface 17S is "a contact surface" of the present invention, and the curvature R17 is "a second curvature" of the present invention. Further, the tangent TL1 is a specific example corresponding to "a first tangent" of the present invention.

(Medium Carrying Part 102)

The medium carrying part 102 includes carrying roller pairs 21-24 that are arranged in this order from upstream to downstream along the carrying path PP, and a cutter 25. The carrying roller pairs 21-24 carry the medium 10 fed out from the medium supply part 101 toward the image forming part 103 and the transfer device 104 on a downstream side. The cutter 25 is arranged between the carrying roller pair 23 and the carrying roller pair 24, and cuts the medium 10 carried over the carrying path PP at a predetermined length. The medium carrying part 102 further includes a carrying motor 812 (described in FIG. 9 below). The carrying roller pairs 21-24 and the cutter 25 are driven by the carrying motor 812.

(Image Forming Part 103)

The image forming part 103 is positioned on a downstream side of the medium carrying part 102, and includes image forming units 30Y, 30M, 30C that are arranged in this order from an upstream side along the carrying path PP. The image forming units 30Y-30C each includes a photosensitive drum 31, a charging roller 32, a development roller 33, a supply roller 34, a development blade 35, a developer container 36, and an LED (Light Emitting Diode) head 37. The image forming units 30Y, 30M, 30C respectively use developers (toners) of mutually different colors to form developer images (toner images) of the respective colors on surfaces of their photosensitive drums 31. Specifically, for example, the image forming unit 30C uses a cyan developer to form a cyan developer image; the image forming unit 30M uses a magenta developer to form a magenta developer image; and the image forming unit 30Y uses a yellow developer to form a yellow developer image. The image forming part 103 further includes a drive motor DM (described in FIG. 9 below). The photosensitive drums 31 and the like are rotationally driven by the drive motor DM.

The photosensitive drums 31 are each a column-shaped member that carries an electrostatic latent image on a surface (surface-layer portion) thereof, and are each structured using a photosensitive body (for example, an organic photosensitive body). The photosensitive drums 31 rotate at a predetermined circumferential speed in a predetermined direction (in this example, rotate clockwise as indicated by an arrow in FIG. 2).

The charging rollers 32 are members (charging members) that respectively charge the surfaces (surface-layer portions) of the photosensitive drums 31, and are respectively arranged so as to be in contact with the surfaces (circumferential surfaces) of the photosensitive drums 31. In this example, the charging rollers 32 rotate counterclockwise.

The development rollers 33 are each a member that carries on a surface thereof a developer for developing an electrostatic latent image, and are respectively arranged so as to be in contact with the surfaces (circumferential surfaces) of the photosensitive drums 31. In this example, the development rollers 33 rotate counterclockwise.

The supply rollers 34 are members (supply members) for respectively supplying developers to the development rollers 33, and are respectively arranged so as to be in contact with surfaces (circumferential surfaces) of the development rollers 33. In this example, the supply rollers 34 rotate counterclockwise (in the same direction as the development rollers 33).

The development blades 35 are developer regulating members that respectively form layers of developers (developer layers) on the surfaces of the rotating development rollers 33, and respectively regulate (control and adjust) thicknesses of the developer layers. The development blades 35 are, for example, plate-like elastic members (plate springs) that are each formed of stainless steel or the like, and front end portions of the plate-like elastic members are respectively arranged near the surfaces of the development rollers 33.

The developer containers 36 are each a container accommodating therein a developer of a predetermined color, and, for example, a developer discharge port is provided at a lower portion of each of the developer containers 36.

The LED heads 37 respectively expose the surfaces of the opposing photosensitive drums 31, and respectively form electrostatic latent images on the surfaces of the photosensitive drums 31.

(Transfer Device 104)

The transfer device 104 is arranged below the image forming part 103 so as to oppose the image forming part 103 across the carrying path PP. As illustrated in FIG. 2, the transfer device 104 includes a carrying belt 41, a drive roller 42 that drives the carrying belt 41, a driven roller 43, transfer rollers 44, and a contact roller 45. The transfer rollers 44 are rotationally driven by the drive motor DM.

The carrying belt 41 is a belt for carrying the medium downstream along the carrying path PP. Specifically, the carrying belt 41 is, for example, an endless elastic belt formed of a resin material such as a polyimide resin, and is stretched by the drive roller 42, the driven roller 43, the transfer rollers 44 and the contact roller 45, and cyclically rotates counterclockwise in FIG. 2. The driven roller 43 rotates following the rotation of the drive roller 42 and the carrying belt 41. The transfer rollers 44 are members for electrostatically transferring developer images formed in the image forming part 103 onto the medium, and are arranged so as to respectively oppose the photosensitive drums 31 across the carrying belt 41. The contact roller 45 is arranged so as to oppose a cleaning blade (not illustrated in the drawings) of the developer collection device 105 across the carrying belt 41, and presses the carrying belt 41 against the cleaning blade.

(Developer Collection Device 105)

The developer collection device 105 is arranged below the transfer device 104 and collects unnecessary developer attached to the carrying belt 41.

(Fuser Device 106)

The fuser device 106 is positioned on a downstream side of the image forming part 103 and the transfer device 104, and functions so as to apply heat and pressure to a developer image transferred onto the medium carried from the transfer device 104, thereby fusing the developer image onto the recording medium. The fuser device 106 includes a fuser roller 61 with a built-in heater 791 (described in FIG. 5 below), and a pressure application roller 62 arranged such that the medium traveling on the carrying path PP is sandwiched between the fuser roller 61 and the pressure application roller 62. The fuser device 106 further includes a thermistor 792 (described in FIG. 9 below) that performs its own temperature detection. The fuser roller 61 is, for example, rotationally driven by the drive motor DM.

(Ejection Part 107)

The ejection part 107 includes, for example, ejection rollers 71, 72 that are arranged opposing each other. The ejection rollers 71, 72 are, for example, rotationally driven by the drive motor DM, and eject the medium ejected from the fuser device 106 to the outside.

[1.2 Configuration of Cutter 16]

Figure 4:
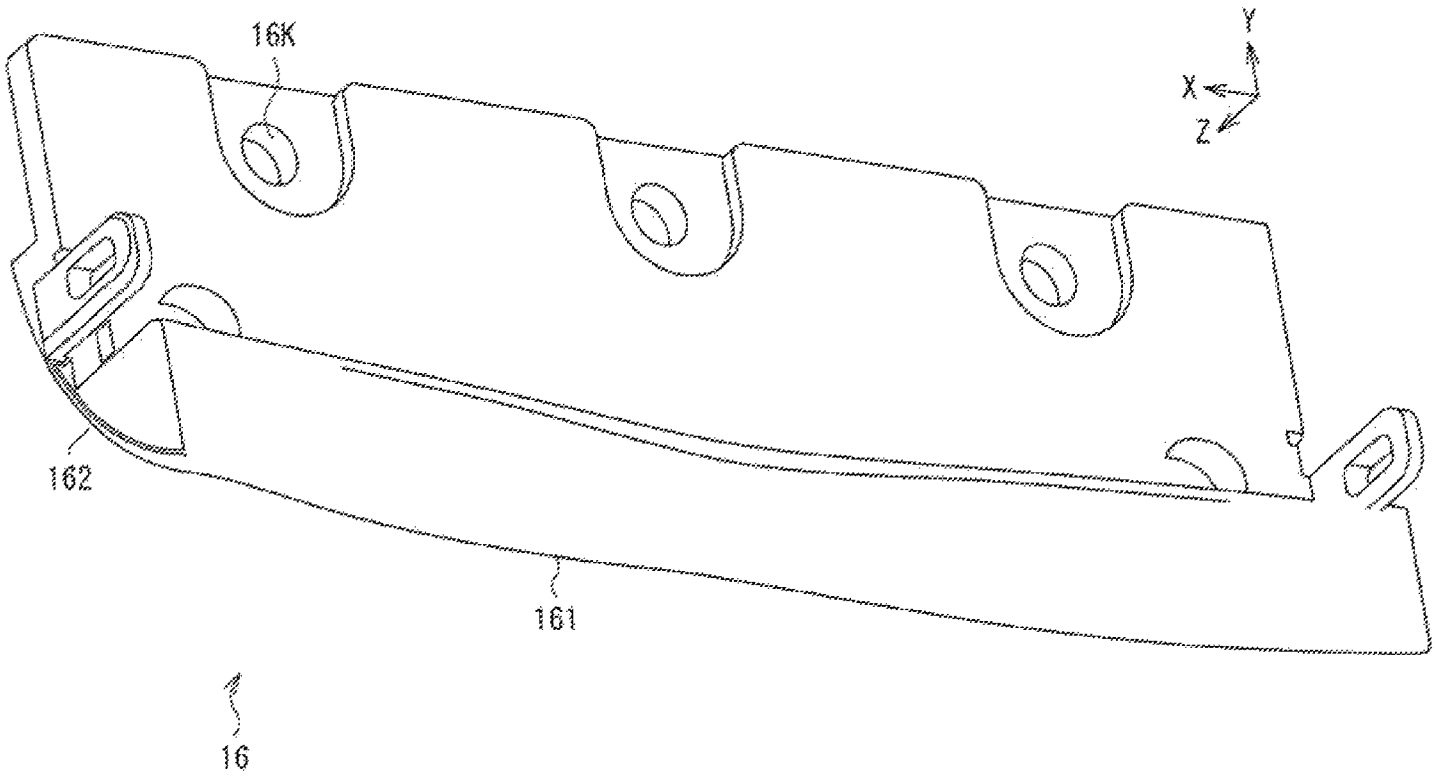
FIG. 4 is a perspective view illustrating a cutting blade illustrated in FIG. 3.
Figure 5:
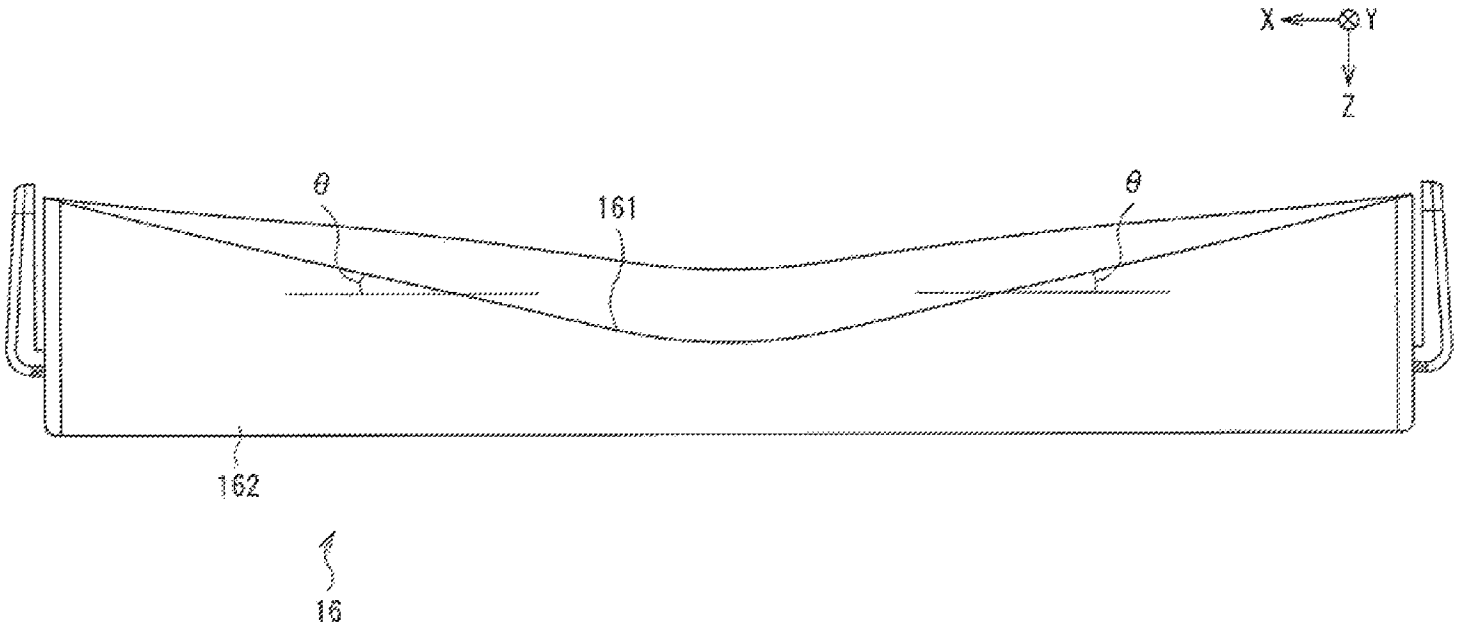
FIG. 5 is a bottom view illustrating an appearance of the cutting blade illustrated in FIG. 3 when the cutting blade is viewed from below.
Figure 6:
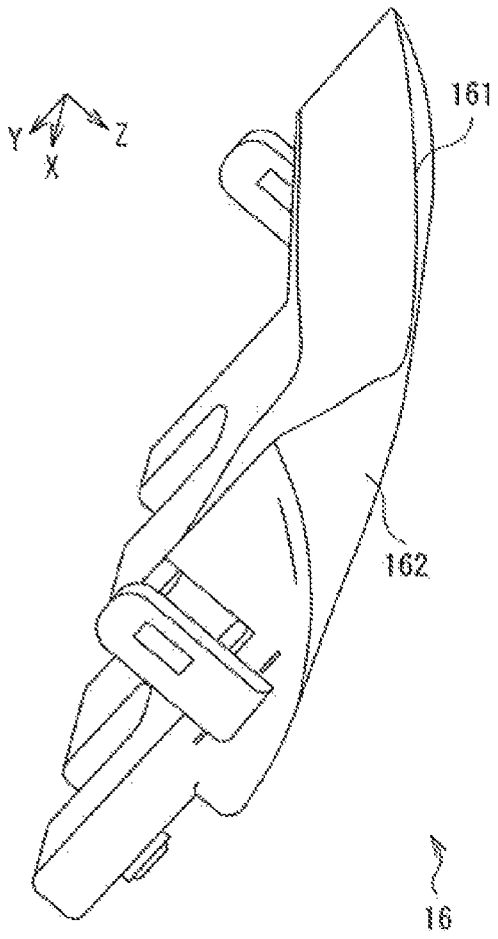
FIG. 6 is another perspective view illustrating the cutting blade illustrated in FIG. 3.
Figure 7:
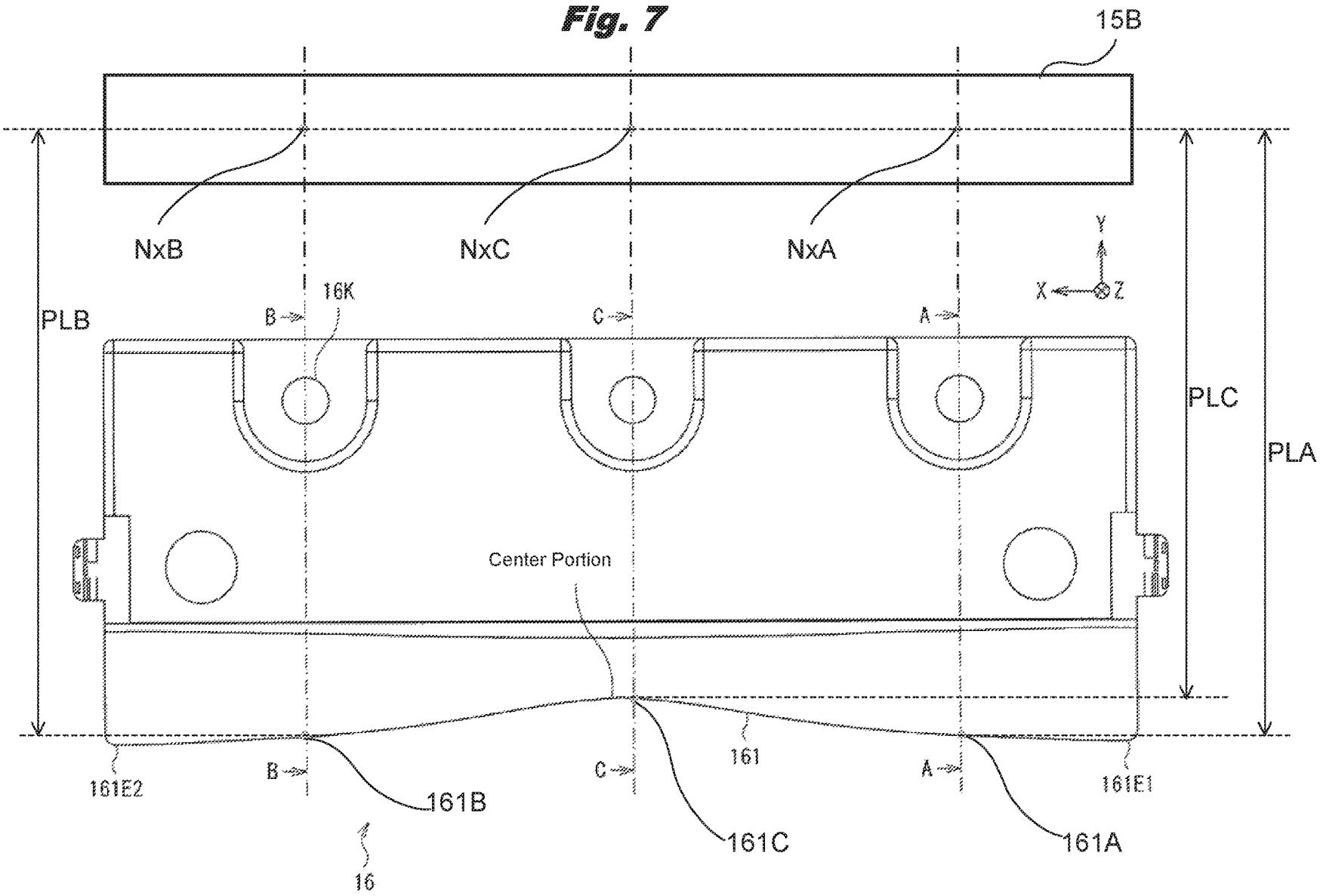
FIG. 7 is a front view illustrating an appearance of the cutting blade illustrated in FIG. 3 when the cutting blade is viewed from front. In order to illustrate three path lengths (PLA-PLC), the drawing includes the pinch roller 15B.
Figure 8A:
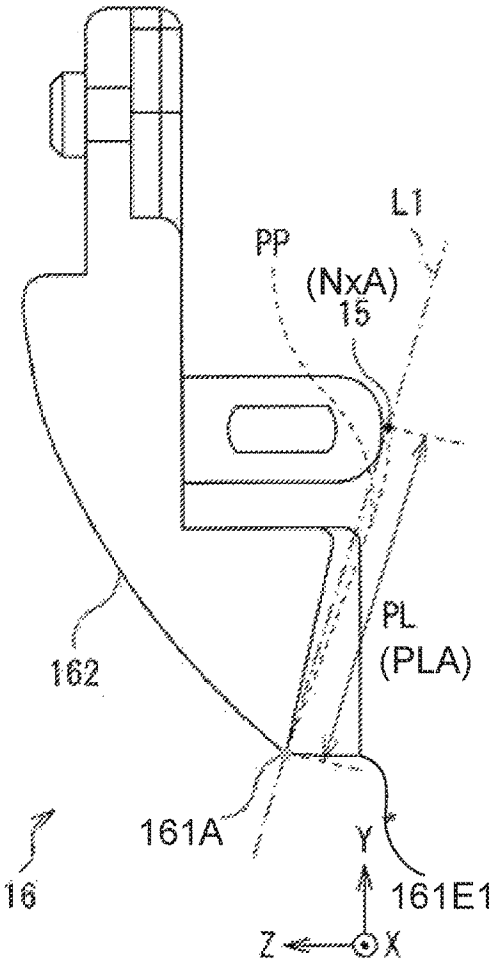
FIGS. 8A-8C are end views mainly illustrating cross-sectional configurations of the cutting blade illustrated in FIG. 3.
Figure 8C:
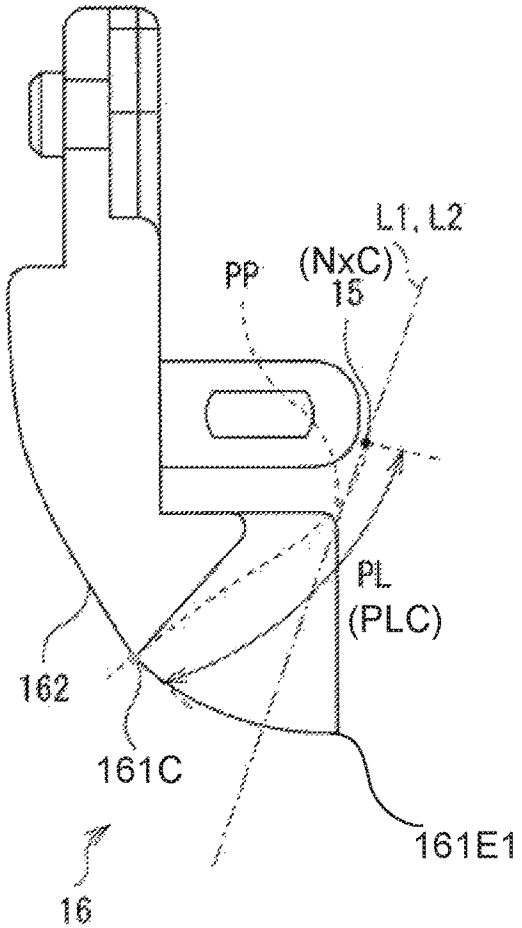
Figure 8B:
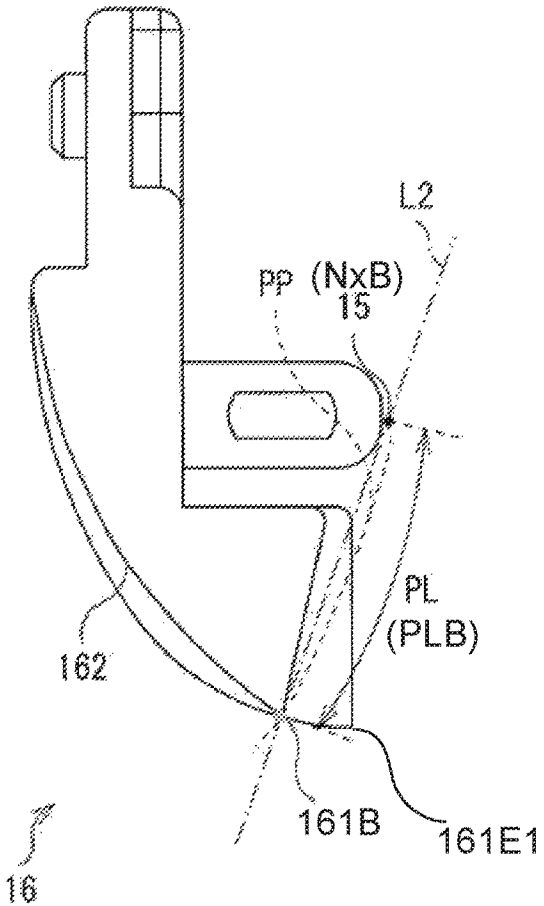

Next, a detailed configuration of the cutter 16 is described with reference to FIGS. 4-8C. FIG. 4 is a perspective view illustrating a configuration example of the cutter 16 illustrated in FIG. 3. FIG. 5 is a bottom view illustrating an appearance of the cutter 16 illustrated in FIG. 3 when the cutter 16 is viewed from below. FIG. 6 is another perspective view illustrating the configuration example of the cutter 16 illustrated in FIG. 3. FIG. 7 is a front view illustrating an appearance of the cutter 16 illustrated in FIG. 3 when the cutter 16 is viewed from front. FIGS. 8A-8C are ends views mainly illustrating cross-sectional configurations of the cutter 16 illustrated in FIG. 3. The end view illustrated in FIG.

8C illustrates a cross section in an arrow direction along a C-C line in FIG. 7. The end view illustrated in FIG. 8A illustrates a cross section in an arrow direction along an A-A line in FIG. 7. The end view illustrated in FIG. 8B illustrates a cross section in an arrow direction along a B-B line in FIG. 7. The cutter 16 is provided with an opening 16K at a portion distant from the edge 161, and can be fixed to the cover 12 by screwing or the like. Points of edges on A-A line, B-B line and C-C line in FIG. 7 respectively correspond to references 161A, 161B and 161C.

As illustrated in FIG. 5, the cutter 16 includes the edge 161 which has a V shape along the X axis direction, and cuts the medium 10 along the X axis direction. Specifically, the edge 161 includes a center portion 161C, and the end portion 161E1 and the end portion 161E2, which sandwich the center portion 161C in the X axis direction. As illustrated in FIGS. 8A-8C, the center portion 161C of the edge 161 is at a position recessed from a first line segment L1 connecting the sandwiching part 15 and the end portion 161E1 and is at a position recessed from a second line segment L2 connecting the sandwiching part 15 and the end portion 161E2. In the present specification and the drawings, the end portion 161E1 and the end portion 161E2 may be collectively referred to as end portions 161E in some cases.

As illustrated in FIGS. 4-8C, in a cross section orthogonal to the X axis direction, the edge 161 of the cutter 16 has a shape that depicts an involute curve in which a path length PL (FIGS. 8A-8C) of the medium 10 from the sandwiching part 15 to the edge 161 is substantially constant. The involute curve depicted by the edge 161 is a continuous curve, and the continuous curve includes a concave portion in the X axis direction. The concave portion referred to here corresponds to the above-described center portion 161C. Of the edge 161 which is a continuous curve, an angle θ (FIG. 5) with respect to the X axis direction at any position of a portion from the center portion 161C toward an end portion of the medium 10 is larger than 0°. The angle θ is desirably 5° or more and 45° or less.

FIG. 7 shows three path lengths (PLA, PLB and PLC). Path length PLA is defined from nip point (NxA) on the pinch roller 15B, which is a part of the sandwiching part, to end portion 161A. Path length PLB is defined from nip point (NxB) on the pinch roller 15B to end portion 161B. Path length PLC is defined from nip point (NxC) on the pinch roller 15B to center portion 161C. In the disclosure of application, references A, B, C following "PL" respectively indicate that the lengths are determined on A-A ling, B-B line and C-C line in FIG. 7.

Figure 11A:
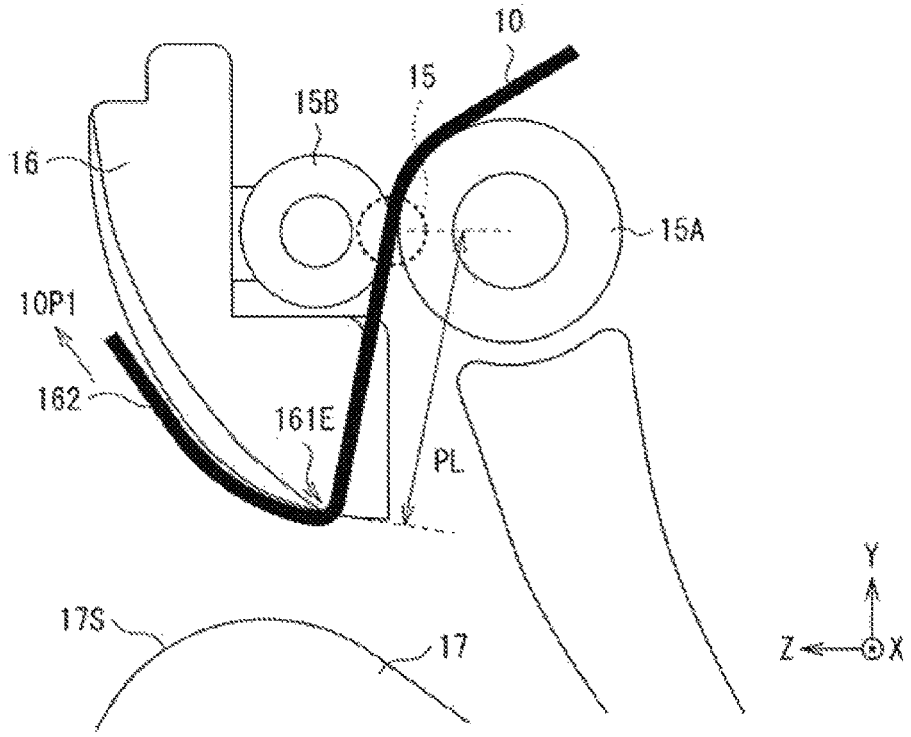
FIG. 11A is a first schematic diagram illustrating how the medium is cut in a vicinity of an end portion of the edge in the image forming apparatus illustrated in FIG. 1A.
Figure 11B:
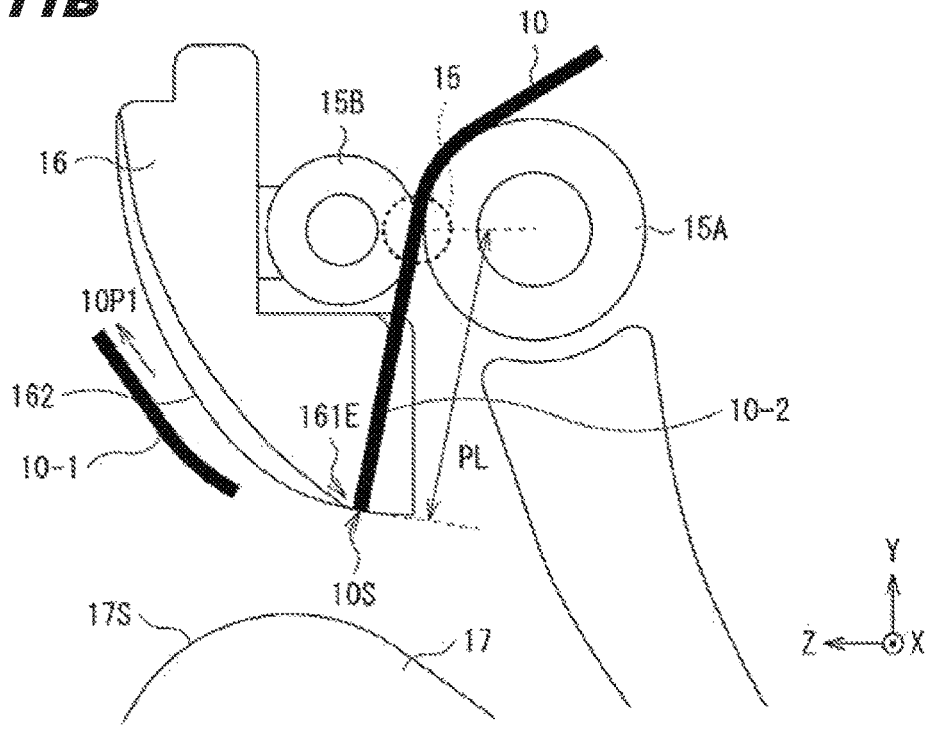
FIG. 11B is a second schematic diagram illustrating how the medium is cut in the vicinity of the end portion of the edge in the image forming apparatus illustrated in FIG. 1A.

The cutter 16 includes a convex side surface 162 that extends away from both the edge 161 and the contact part 17 starting from the edge 161 and has a curvature smaller than the curvature R161, the curvature being large enough to cut the medium. The cutting motion is illustrated in FIGS. 11A and 11B. The side surface 162 opposes the contact surface 17S. The side surface 162 is a surface that has a possibility of being in contact with the medium 10 in a case where the contact surface 17S is not in contact with the medium 10 when the medium 10 is cut at the edge 161. When the side surface 162 is in contact with the medium 10, the side surface 162 functions as a support part supporting the medium 10. The side surface 162 is desirably formed of only a continuous surface that does not include a bent portion. This is to avoid that a localized stress is applied to the medium 10 in contact with the side surface 162. The side surface 162 is a specific example corresponding to "a side surface" of the present invention, and the curvature R162 is "a third curvature" of the present invention.

As illustrated in FIG. 3, the contact surface 17S is positioned on an opposite side with respect to the sandwiching part 15 across a second straight line SL2 passing through the edge 161. The second straight line SL2 is orthogonal to a first straight line SL1 passing through the sandwiching part 15 and the edge 161. Here, an angle a formed by a second tangent TL2 of a second contact surface passing through the edge with respect to the second straight line SL2 is preferably 0° or more and 55° or less.

[1-3. Circuit Configuration of Image Forming Apparatus 1]

Figure 9:
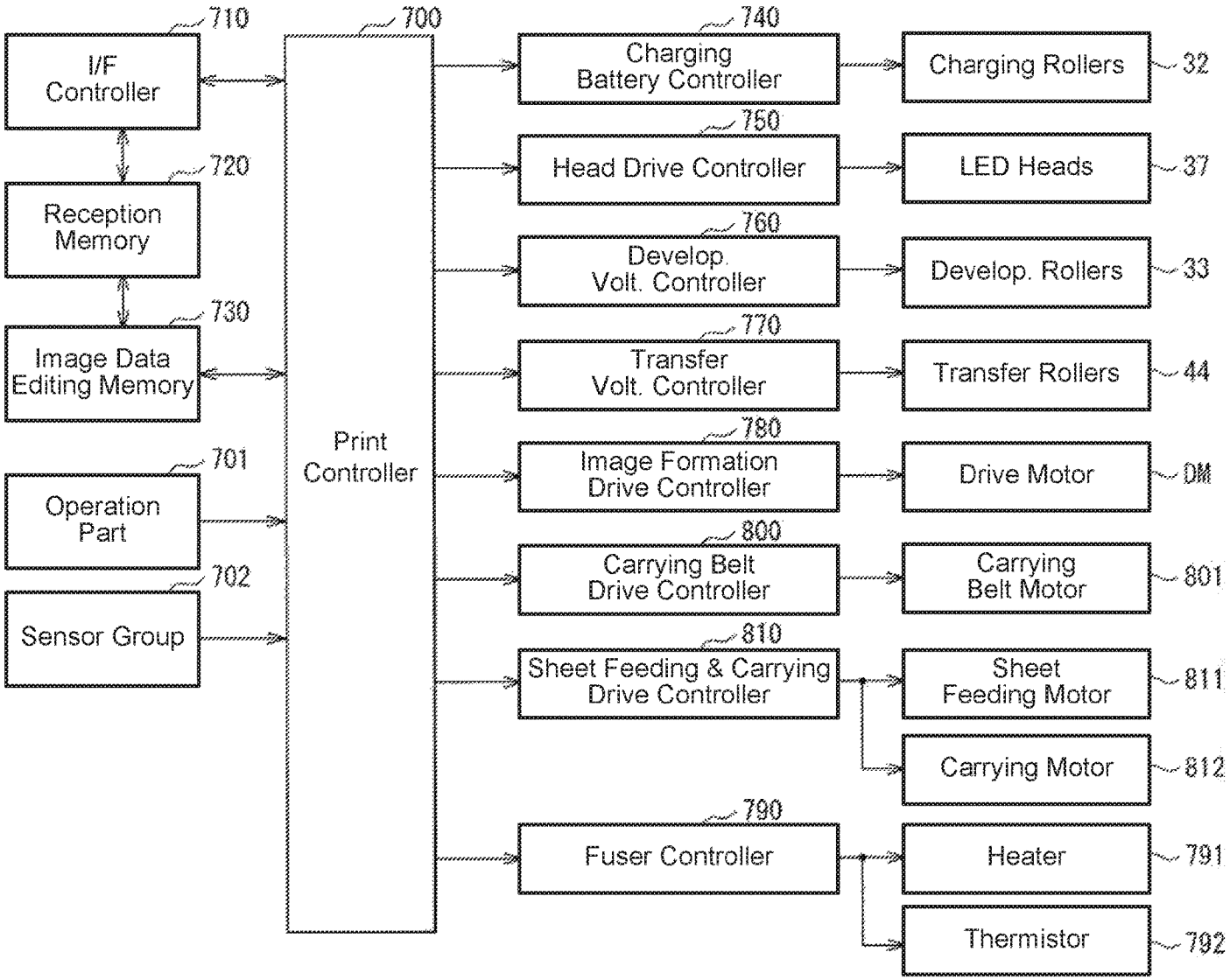
FIG. 9 is a block diagram schematically illustrating an internal configuration example of the image forming apparatus illustrated in FIG. 1A.

FIG. 9 illustrates a block diagram schematically illustrating an internal configuration of the image forming apparatus 1. As illustrated in FIG. 9, the image forming apparatus 1 includes a print controller 700, an I/F controller 710, a reception memory 720, an image data editing memory 730, an operation part 701 and a sensor group 702. The image forming apparatus 1 further includes a charging voltage controller 740, a head drive controller 750, a development voltage controller 760, a transfer voltage controller 770, an image formation drive controller 780, a fuser controller 790, a carrying belt drive controller 800, and a sheet feeding and carrying drive controller 810, which each receive a command from the print controller 700.

The print controller 700 is configured by a microprocessor, a ROM, a RAM, an input and output port, and the like, and controls the entire processing operation of the image forming apparatus 1 by executing, for example, a predetermined program. Specifically, the print controller 700 receives print data and a control command from the I/F controller 710, and performs a print operation by integrally controlling the charging voltage controller 740, the head drive controller 750, the development voltage controller 760, the transfer voltage controller 770, the image formation drive controller 780, the fuser controller 790, the carrying belt drive controller 800 and the sheet feeding and carrying drive controller 810.

The I/F controller 710 receives the print data and the control command from an external device such as a personal computer (PC), or transmits a signal related to a state of the image forming apparatus 1.

The reception memory 720 temporarily stores the print data from the external device such as a PC via the I/F controller 710.

The image data editing memory 730 receives the print data stored in the reception memory 720 and stores image data obtained by editing the print data.

The operation part 701, for example, has an LED lamp for displaying information about the state of the image forming apparatus 1 and the like, and has an input part (a button or a touch panel) for allowing a user to give an instruction to the image forming apparatus.

The sensor group 702 includes various sensors for monitoring an operation state of the image forming apparatus 1, for example, a position sensor that detects a position of the medium, a temperature sensor that detects a temperature in the image forming apparatus 1, a print density sensor, and the like.

The charging voltage controller 740, according to an instruction from the print controller 700, performs control so as to apply charging voltages to the charging rollers 32 and charge the surfaces of the photosensitive drums 31.

The head drive controller 750, according to the image data stored in the image data editing memory 730, performs control of an exposure operation by the LED heads 37.

The development voltage controller 760, based on an instruction from the print controller 700, performs control so as to apply development voltages to the development rollers 33, and develop toners to the electrostatic latent images formed on the surfaces of the photosensitive drums 31.

The transfer voltage controller 770, based on an instruction from the print controller 700, performs control so as to apply transfer voltages to the transfer rollers 44, and transfer the toner images onto the medium.

The image formation drive controller 780, based on an instruction from the print controller 700, performs drive control of the drive motor DM. The drive motor DM performs rotation driving of the photosensitive drums 31 and the like.

The fuser controller 790, based on an instruction from the print controller 700, controls a fuse operation of the fuser device 106. Specifically, the fuser controller 790 performs control of an applied voltage to the heater 791 (FIG. 9) built in the fuser roller 61. The fuser controller 790, based on a temperature of the fuser device 106 measured by the thermistor 792, performs On-Off control of an applied voltage to the heater 791.

The carrying belt drive controller 800, based on an instruction from the print controller 700, performs operation control of a carrying belt motor 801 provided in the image forming apparatus 1. The carrying belt motor 801 performs driving of the carrying belt 41.

The sheet feeding and carrying drive controller 810, based on an instruction from the print controller 700, performs operation control of the sheet feeding motor 811 and the carrying motor 812, which are provided in the image forming apparatus 1.

[1.4 Operation Effects]

(A. Basic Operation)

In the image forming apparatus 1, a developer image is transferred to the medium as follows.

Specifically, first, based on the control of the sheet feeding and carrying drive controller 810, the sheet feeding motor 811 performs driving, and the carrying roller 15A rotates. As a result, the medium 10 is picked up from the roll Rp accommodated in the space 101S in the medium supply part 101 and is fed out by the carrying roller 15A in a direction toward the medium carrying part 102 on a downstream side. Next, the medium 10 fed out from the roll Rp is carried toward the image forming part 103 and the transfer device 104 on a downstream side while a skew is corrected by the medium carrying part 102. At the medium carrying part 102, the medium 10 is cut at a predetermined length by the cutter 25. In this case, based on the control of the sheet feeding and carrying drive controller 810, a driving force of the sheet feeding motor 811 is transmitted to the cutter 25.

At the image forming part 103 and the transfer device 104, a toner image is transferred onto the medium 10 as follows. First, print image data and a print command are input to the print controller 700 from an external device such as a PC via the I/F controller 710 to the image forming apparatus 1 in an activated state. In response to the print command, the print controller 700, in cooperation with the image formation drive controller 780 or the like, starts a print operation of the print image data.

The image formation drive controller 780 drives the drive motor DM to rotate the photosensitive drums 31 in a predetermined direction at a constant speed. When the photosensitive drums 31 rotate, motive forces of the photosensitive drums 31 are respectively transmitted to the supply rollers 34, the development rollers 33 and the charging rollers 32 via drive transmission parts such as gear trains. As a result, the supply rollers 34, the development rollers 33 and the charging rollers 32 each rotate in a predetermined direction.

On the other hand, based on a command from the print controller 700, the charging voltage controller 740 respectively applies predetermined voltages to the charging rollers 32 to uniformly charge the surfaces of the photosensitive drums 31.

Next, the head drive controller 750 activates the LED heads 37 to irradiate the photosensitive drums 31 with light corresponding to a print image based on an image signal to respectively form electrostatic latent images on the surfaces of the photosensitive drums 31. Further, developers are respectively supplied from the developer containers 36 to the supply rollers 34. The developers are respectively carried by the supply rollers 34 and are respectively moved to vicinities of the development rollers 33 with the rotations of the supply rollers 34. Therefore, the developers are respectively, for example, negatively charged due to potential differences between potentials of the development rollers 33 and potentials of the supply rollers 34, and are respectively supplied to the development rollers 33. The developers that are respectively supplied to the development rollers 33 respectively form developer layers which are respectively regulated by the development blades 35 to each have a predetermined thickness.

Further, in accordance with the electrostatic latent images that are respectively formed on the surfaces of the photosensitive drums 31, the developer layers on the development rollers 33 are developed, and developer images are respectively formed on the photosensitive drums 31. The developer images are transferred to the medium 10 on the carrying path PP by electric fields between the photosensitive drums 31 and the transfer rollers 44, the transfer rollers 44 being respectively arranged opposing the photosensitive drums 31 and predetermined voltages being respectively applied to the transfer rollers 44 by the transfer voltage controller 770.

Thereafter, at the fuser device 106, heat and pressure are applied to the developer images transferred onto the medium 10, and the developer images are fused on the medium 10. Thereafter, the medium 10 onto which the developer images have been fused is ejected to the outside by the ejection part 107.

There may be a case where a small amount of developer not transferred to the medium 10 remains on the photosensitive drums 31. In this case, the remaining developer may adhere to the carrying belt 41. Therefore, in the image forming apparatus 1, the developer collection device 105 collects the developer adhering to the carrying belt 41 as waste toner.

(B. Cueing Operation of Medium 10 from Roll Rp)

As a process of a stage before a driving operation of the image forming apparatus 1 is performed, the roll Rp is accommodated in the space 101S of the medium supply part 101 and the leading edge surface 10S (to be described later) extending along the X axis direction is formed. Specifically, first, the cover 12 is opened and the roll Rp is placed in a portion of the case 2 where the space 101S is formed. Next, the user pulls out an outermost peripheral end portion of the roll Rp to the outside of the case 2, and then closes the cover 12. By closing the cover 12, the medium 10 pulled out by the user is sandwiched between the carrying roller 15A and the pinch roller 15B.

Figure 10A:
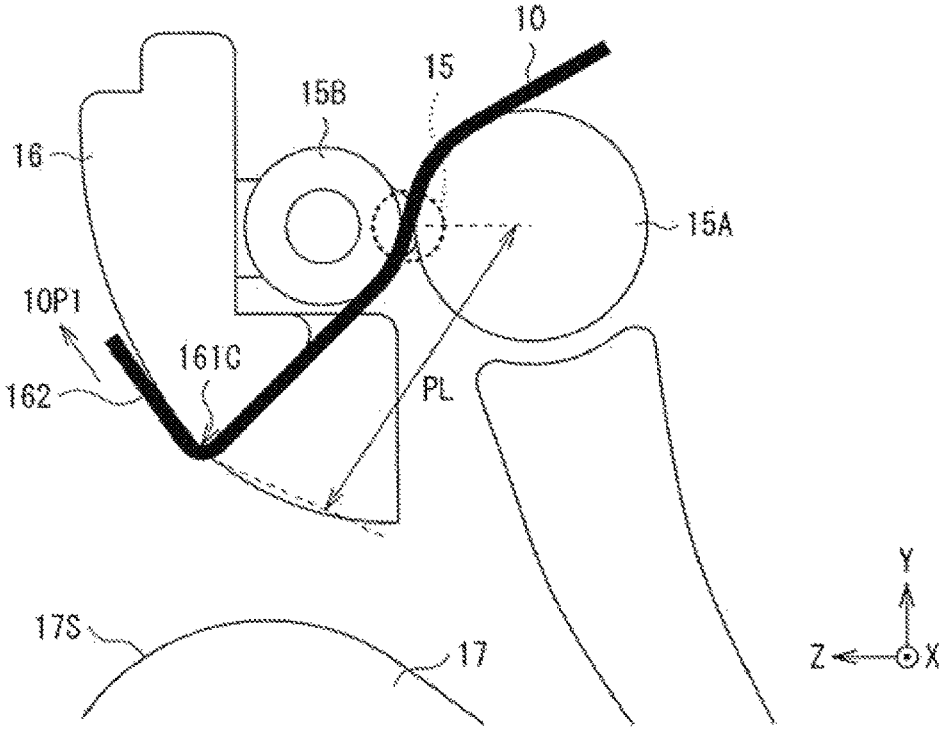
FIG. 10A is a first schematic diagram illustrating how a medium is cut in a vicinity of a center portion of an edge in the image forming apparatus illustrated in FIG. 1A.

Thereafter, for example, as illustrated in FIGS. 10A and 11A, the user pulls with his/her own hand the end portion of the pulled out medium 10 obliquely upward (in an arrow 10P1 direction), thereby applying a stress to the medium 10.

Figure 10B:
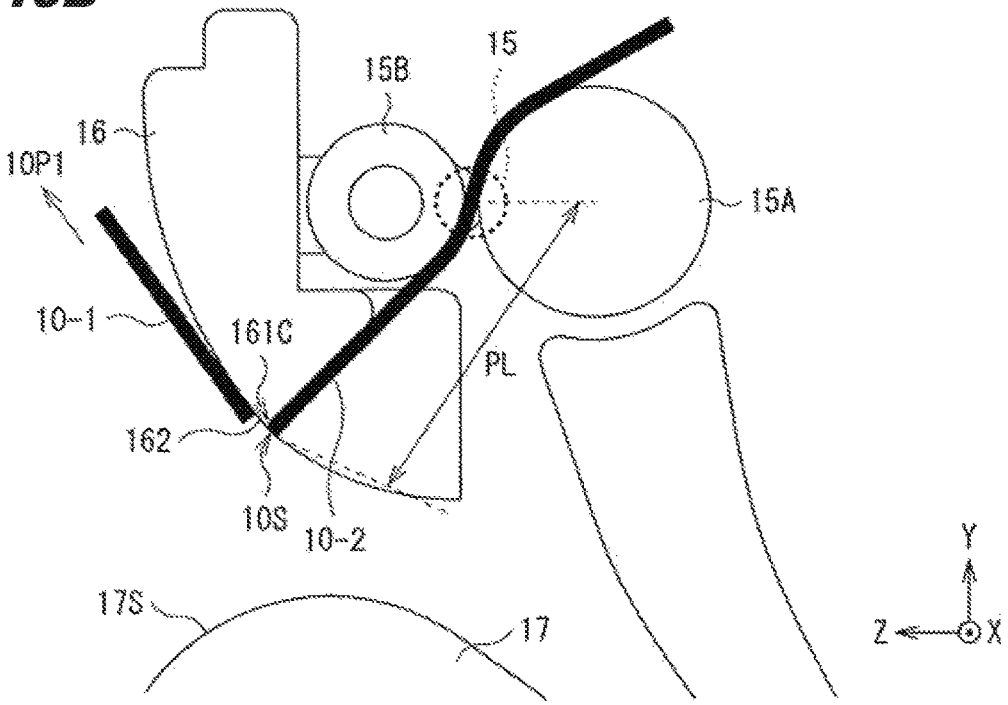
FIG. 10B is a second schematic diagram illustrating how the medium is cut in the vicinity of the center portion of the edge in the image forming apparatus illustrated in FIG. 1A.

In this case, the end portion of the medium 10 is in contact with the side surface 162. As a result of this operation, a shear stress effectively concentrates on a portion of the medium 10 that is in contact with the edge 161, and, for example, as illustrated in FIGS. 10B and 11B, the medium 10 breaks at a place (stress concentration place) of the medium 10 where the shear stress concentrates. Here, FIGS. 10A and 10B are schematic diagrams illustrating how the medium 10 is cut in a vicinity of the center portion 161C of the edge 161, and FIGS. 11A and 11B are schematic diagrams illustrating how the medium 10 is cut in a vicinity of the end portion 161E of the edge 161. FIGS. 10A and 11A each illustrate a state immediately before the medium 10 is cut by the edge 161. As illustrated in FIGS. 10A and 11A, when the users pulls the end portion of the medium 10 obliquely upward, the medium 10 is in contact with the side surface 162 of the cutter 16. Therefore, the medium 10 is supported at two places, the sandwiching part 15 and the side surface 162. Therefore, the portion of the medium 10 near the edge 161 positioned between the sandwiching part 15 and the side surface 162 is a stress concentration place. As a result, as illustrated in each of FIGS. 10B and 11B, the medium 10 breaks at the stress concentration place. A front end portion 10-1 of the medium 10 is detached, and a leading edge surface 10S cut with high accuracy is formed in a remaining portion 10-2 of the medium 10. FIGS. 10B and 11B each illustrate a state immediately after the medium 10 is cut by the edge 161.

Here, the path length PL of the carrying path PP from the sandwiching part 15 to the center portion 161C and the path length PL of the carrying path PP from the sandwiching part 15 to the end portion 161E are substantially the same. This is because the edge 161 has a shape that depicts an involute curve in the cross section (YZ cross section) orthogonal to the X axis direction. Therefore, the leading edge surface 10S is substantially parallel to the X axis direction. Further, in the present embodiment, the center portion 161C is at a position that is more recessed from the carrying path PP than the end portions 161E1, 161E2. Therefore, cracking of the medium 10 starts from the end portions 161E1, 161E2 and progresses toward the center portion 161C, and, finally, cutting of the medium 10 is completed in the vicinity of the center portion 161C.

Figure 12A:
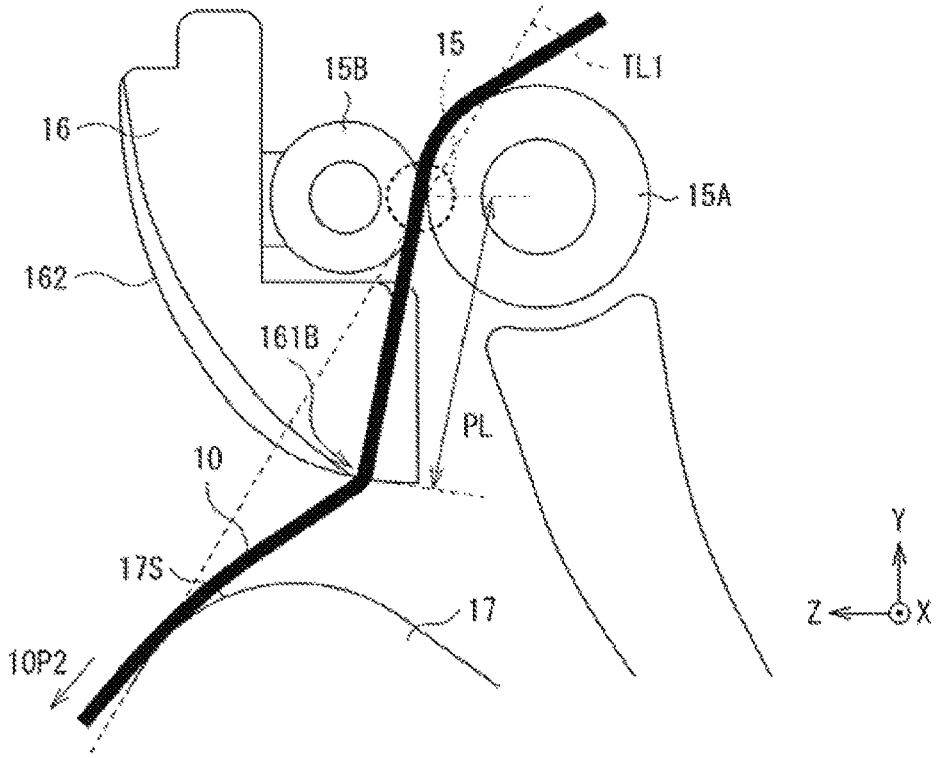
FIG. 12A is a third schematic diagram illustrating how the medium is cut in the vicinity of the end portion of the edge in the image forming apparatus illustrated in FIG. 1A.
Figure 12B:
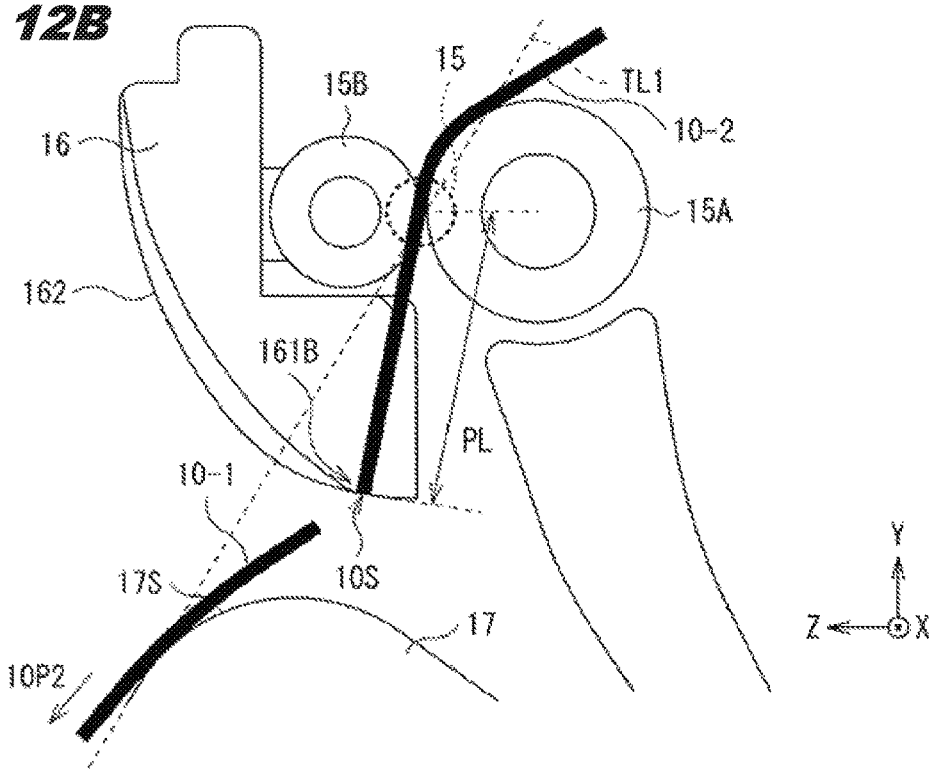
FIG. 12B is a fourth schematic diagram illustrating how the medium is cut in the vicinity of the end portion of the edge in the image forming apparatus illustrated in FIG. 1A.

On the other hand, in the image forming apparatus 1 of the present embodiment, for example, as illustrated in FIG. 12A, even when the user pulls with his/her own hand the end portion of the pulled out medium 10 obliquely downward (in an arrow 10P2 direction), the medium 10 can be accurately cut. Specifically, when the user pulls the end portion of the medium 10 obliquely downward, the medium 10 is brought into contact with the contact surface 17S of the contact part 17. As a result, the medium 10 is supported at two places, the sandwiching part 15 and the contact surface 17S. Therefore, the portion of the medium 10 near the edge 161 positioned between the sandwiching part 15 and the contact surface 17S is a stress concentration place, and, as illustrated in FIG. 12B, the medium 10 breaks at the stress concentration place. As a result, a front end portion of the medium 10 is detached, and a leading edge surface 10S cut with high accuracy is formed in a remaining portion 10-2 of the medium 10. FIGS. 12A and 12B each illustrate a state when the user pulls with his/her own hand the end portion of the medium 10 obliquely downward. In particular, FIG. 12A illustrates a state immediately before the medium 10 is cut by the end portion 161B of the edge 161, and FIG. 12B illustrates a state immediately after the medium 10 is cut by the end portion 161B of the edge 161.

Also in the cases illustrated by FIGS. 12A and 12B, the leading edge surface 10S is substantially parallel to the X axis direction. Further, cracking of the medium 10 starts from the end portions 161E1, 161E2 and progresses toward the center portion 161C, and, finally, cutting of the medium 10 is completed in the vicinity of the center portion 161C.

The remaining portion 10-2 of the medium 10 in which the leading edge surface 10S is formed is carried from the medium supply part 101 to the medium carrying part 102 along the carrying path PP by the rotation operation of the carrying roller 15A.

(C. Effects)

In this way, in the present embodiment, even when the user pulls the medium 10 either obliquely upward (in the arrow 10P1 direction) or obliquely downward (in the arrow 10P2 direction), the medium 10 breaks in the vicinity of the edge 161, and, as a result, the leading edge surface 10S is formed in the medium 10. Therefore, even when the user pulls with his/her own hand the end portion of the medium 10 obliquely upward or obliquely downward, the same leading edge surface 10S can be stably obtained. Therefore, it is a user-friendly medium cutting device.

In the present embodiment, in a cross section (YZ cross section) orthogonal to the X axis direction, the edge 161 that cuts the medium 10 has a shape that depicts an involute curve in which the path length of the medium 10 from the sandwiching part 15 to the edge 161 is substantially constant. Therefore, a stable cutting operation is performed with respect to the medium 10 from an end portion on one side of the medium 10 to an end portion on the other side of the medium 10 along the X axis direction. Therefore, the cutting operation of the medium 10 can be performed with higher accuracy. Further, the resulting leading edge surface 10S is an edge surface that is substantially parallel to the X axis direction.

Further, in the present embodiment, the center portion 161C of the edge 161 is at a position recessed from the first line segment L1 connecting the sandwiching part 15 and the end portion 161E1 and is at a position recessed from the second line segment L2 connecting the sandwiching part 15 and the end portion 161E2. Therefore, the edge 161 has a shape in which the center portion 161C is more recessed than the end portions 161E1, 161E2. Therefore, when the medium 10 breaks, breaking is started from both the end portion 161E1 and the end portion 161E2, and cracking propagates toward the center portion 161C. Therefore, a leading edge surface 10S that is a sharper breaking surface is obtained. In particular, when the angle θ is 5° or more and 45° or less, the cutting operation of the medium 10 can be performed with a smaller tensile force. Further, making the above-described involute curve a continuous curve is advantageous for forming a smoother leading edge surface 10S.

Further, in the present embodiment, the cutting operation of the medium 10 is executed due to mechanical structures of the cutter 16 and in the vicinity of the cutter 16, and thus, an additional actuator or an additional control signal is not required. Therefore, no complication in mechanism is required.

2. Modified Embodiments

In the above, the present invention is described by illustrating the embodiment. However, the present invention is not limited to above-described embodiment, and various modifications are possible. For example, in the above-described embodiment, an image forming apparatus forming a color image is described. However, the present invention is not limited to this, and, for example, may be an image forming apparatus in which only a black toner image is transferred and a monochrome image is formed. Further, in the above-described embodiment, a primary transfer type (direct transfer type) image forming apparatus is described. However, the present invention can also be applied to a secondary transfer type image forming apparatus.

Further, the shapes, quantities, sizes and positional relations of the components described in the above-described embodiment are for illustrating an example, and the present invention is not limited to these.

Further, in the above-described embodiment, the LED heads using light emitting diodes as light sources are used as exposure devices. However, for example, it is also possible to use exposure devices that use laser elements or the like as light sources.

Further, in the above-described embodiment, as a specific example of the "image forming apparatus" of the present invention, an image forming apparatus having a print function is described. However, the present invention is not limited to this. That is, for example, the present invention is also applicable to an image forming apparatus that functions as a multifunction machine having a scan function and a fax function, in addition to the print function.

Further, in the above-described embodiment, the medium cutting device of the present invention is provided in the medium supply part 101. However, the image forming apparatus of the present invention is not limited to this. For example, it is also possible to provide the medium cutting device of the present invention in the ejection part 107.

LEGEND

1: image forming apparatus
2: case
101: medium supply part
10: medium
11: holding part
12: cover
14: guide
15: sandwiching part
15A: carrying roller
15B: pinch roller
16: cutter
161: edge
161C: center portion
161E1, 161E2: end portions
162: side surface
17: contact part
17S: contact surface
102: medium carrying part
21-24: carrying roller pairs
25: cutter
103: image forming part
30A-30C: image forming units
31: photosensitive drum
32: charging roller
33: development roller
34: supply roller
35: development blade
36: developer container
37: LED head
104: transfer device
41: carrying belt
42: drive roller
43: driven roller
44: transfer roller
45: contact roller
105: developer collection device
106: fuser device
61: fuser roller
62: pressure application roller
71, 72: ejection rollers
107: ejection part
PP: carrying path

What is claimed is:

1. A medium cutting device cutting a continuous medium carried along a carrying path in a carrying direction, comprising:

a sandwiching part that is provided capable of sandwiching a medium; and a cutting blade that includes an edge extending in a width direction (X) of the medium, which is perpendicular to the carrying direction, wherein the medium is cut by the edge while the medium is sandwiched and held by the sandwiching part, and the cutting blade is fixed when cutting the medium, wherein the edge is formed on an involute curve with respect to the sandwiching part, and the edge includes a concave portion with a curved shape along the width direction.

2. The medium cutting device according to claim 1, wherein the edge cuts the medium in the width direction, and of the edge, an angle between the width direction and any position of a portion from the concave portion is 5° or more and 45° or less.

3. The medium cutting device according to claim 1, wherein the involute curve is formed with multiple curves continuously connecting.

4. The medium cutting device according to claim 1 further comprising:

a contact part that includes a convex contact surface that is positioned on an opposite side with respect to the sandwiching part as viewed from the edge and is capable of being in contact with the medium, wherein at least a portion of the edge is positioned on the contact part side of a first tangent of the contact surface passing through the sandwiching part.

5. The medium cutting device according to claim 4, wherein the edge has a first curvature, and the contact surface has a second curvature that is smaller than the first curvature.

6. The medium cutting device according to claim 5, wherein the contact surface is formed of only a continuous surface.

7. The medium cutting device according to claim 5, wherein the cutting blade further includes a side surface that is convex, extends away from both the edge and the contact part starting from the edge, and has a third curvature that is smaller than the first curvature.

8. The medium cutting device according to claim 7, wherein the side surface is formed of only a continuous surface.

9. The medium cutting device according to claim 1, wherein the sandwiching part is composed with a pair of bodies that are arranged opposing each other across the carrying path over which the medium is carried, one of the bodies is a roller, and the other of the bodies is either another roller or a plate.

10. The medium cutting device according to claim 1, wherein the sandwiching part is composed with a pair of rollers that are arranged opposing each other across the carrying path over which the medium is carried.

11. The medium cutting device according to claim 1, wherein the concave portion is disposed at a center of the edge and a pair of end portions disposed at both sides of the concave portion with respect to the width direction, and seen from a view of the width direction, the center portion is positioned at a downstream side of the carrying path from these end portions.

12. The medium cutting device according to claim 1, wherein the cutting blade is formed of a resin.

13. An image forming apparatus comprising:

the medium cutting device according to claim 1; and an image forming part that is configured to process an image forming.

14. The image forming apparatus according to claim 13 further comprising:

a medium supply part that supplies the medium toward the image forming part, wherein the medium passes through from the medium supply part toward the image forming part over the carrying path, and the medium cutting device removes a front end portion of the medium pulled out from the medium supply part, and then guides the medium from which the front end portion has been removed to the carrying path.

15. The medium cutting device according to claim 1, wherein the sandwiching part and the cutting blade are positioned on the carrying path of the medium and the cutting blade are positioned downstream of the sandwiching part.

16. The medium cutting device according to claim 1, further including a cover, wherein the cutting blade is fixed to the cover.

* * * * *